US006266926B1

(12) United States Patent
Figge et al.

(10) Patent No.: US 6,266,926 B1
(45) Date of Patent: Jul. 31, 2001

(54) GAS GENERATOR DEPLOYED OCCUPANT PROTECTION APPARATUS AND METHOD

(75) Inventors: Ward Figge, Dale City; Kenneth Graham, Warrenton, both of VA (US); John Crawford, Topanga, CA (US)

(73) Assignee: Atlantic Research Corporation, Gainesville, VA (US)

( * ) Notice: Subject to any disclaimer, the term of this patent is extended or adjusted under 35 U.S.C. 154(b) by 0 days.

(21) Appl. No.: 09/431,084

(22) Filed: Nov. 1, 1999

(51) Int. Cl.[7] ..... E04H 14/00

(52) U.S. Cl. ..... 52/1; 52/2.11; 102/303; 49/9

(58) Field of Search ..... 102/303; 52/1, 52/2.11, 2.18, 2.14; 49/9, 31, 50; 160/1, 90, 3, 7

(56) References Cited

U.S. PATENT DOCUMENTS

| | | | | |
|---|---|---|---|---|
| 3,831,318 | * | 8/1974 | Richmond | 49/31 |
| 4,040,210 | * | 8/1977 | Land | 160/90 |
| 4,187,896 | | 2/1980 | Shore . | |
| 4,262,045 | | 4/1981 | Cheng et al. . | |
| 4,344,473 | | 8/1982 | Shore . | |
| 4,346,132 | | 8/1982 | Cheng et al. . | |
| 5,647,438 | | 7/1997 | Chatrathi et al. . | |
| 5,653,062 | | 8/1997 | Shustov . | |
| 5,719,350 | | 2/1998 | Parkes et al. . | |
| 5,732,510 | | 3/1998 | Sutton et al. . | |

FOREIGN PATENT DOCUMENTS

0161002 * 11/1985 (EP) ..... 52/1

* cited by examiner

*Primary Examiner*—Peter M. Cuomo
*Assistant Examiner*—Jerry Anderson
(74) *Attorney, Agent, or Firm*—Nixon & Vanderhye PC; Frank P. Presta

(57) ABSTRACT

An apparatus and method for protecting an occupant of a building from flying debris from a frangible structure of the building, such as a window or the like, in the event of an explosion or other blast. A protective barrier is positioned adjacent the building structure and is constructed to be deployed by inflation of at least a portion thereof. The protective barrier is movable from a stored position adjacent the building structure to a deployed position in which it covers the building structure. A gas generating device is connected to the protective barrier and is operable to generate gas to inflate the protective barrier and move it to the deployed position in response to the sensing of an explosion or other blast by a sensing device located remote from the building.

12 Claims, 4 Drawing Sheets

Window Protection Unit

Cradenza Protection Unit

Valence Protection Unit (STORED POSITION)

GAS GENERATOR DEPLOYED OCCUPANT PROTECTION APPARATUS AND METHOD

BACKGROUND OF THE INVENTION

The present invention relates generally to an apparatus and method for protecting building occupants from injury caused by flying debris from an explosion or the like. More particularly, it relates to such an apparatus and method wherein a gas generator is used to deploy a protective barrier such as an air bag or the like.

Terrorist bomb attacks provide a demonstrable need for increased protection for building occupants from the debris hazards generated by the blast. Loss of life in such attacks is caused mainly by the debris hazard generated by the blast (i.e., debris from the breakup of the windows, cladding, and ceiling and room fixtures. While debris hazards can be mitigated by the use of increased standoff, airblast barriers, stronger cladding and windows, and window coatings, such devices merely reduce but do not totally eliminate the personnel injury and, in many cases, are difficult and/or expensive to install.

Accordingly, a need has arisen for a simple and effective protection system that provides a "last line of defense" for the occupants of a building subjected to an explosion and prevents or significantly reduces injury to the occupants. The protection apparatus and method of the present invention fills this need and is not subject to any of the disadvantages of previously used systems.

SUMMARY OF THE INVENTION

In the method and apparatus of the present invention, a protective barrier which can be deployed by inflation is mounted adjacent a window or other structure providing a debris hazard in the event of an explosion. The protective barrier is movable from a stored position adjacent the window to a deployed position wherein it covers the window to prevent injury to the occupants from flying debris from the window. Preferably, the protective barrier is mounted on the inside of the window or other structure, although it could be mounted on the outside thereof.

A suitable type of gas generating device is used to deploy the inflatable protection barrier in the event of an explosion. As an illustrative example, a suitable sensor may be mounted outside of the building to detect an explosion and activate an igniter which would then ignite a suitable gas generating composition to rapidly generate gas for deploying the protective barrier by inflation. Such a system would operate to deploy the protective barrier in about one illisecond such that the window would be covered before it is subjected to the explosion blast to prevent flying debris from the window and protect the building occupants from injury from such debris. The gas generating composition could use a solid propellant, a liquid propellant, or a mixture thereof.

The protective barrier and inflation apparatus of the present invention may be mounted in any suitable housing disposed adjacent the window or other structure, such as a window valance, piece of furniture or the like, so that it is hidden from view in the stored position.

DESCRIPTION OF THE PREFERRED EMBODIMENTS

Figure 1:
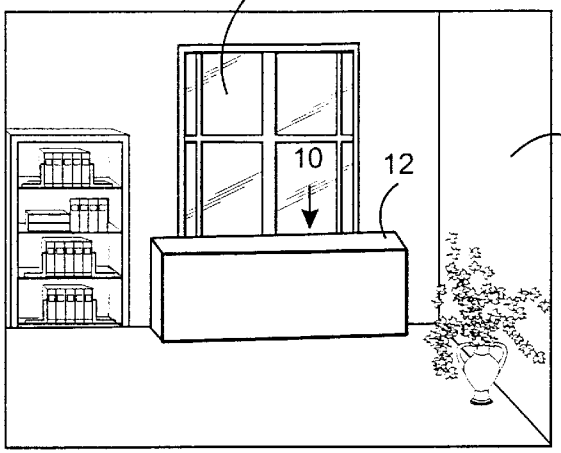
FIG. 1 is a front elevational view of a first embodiment of the present invention wherein the protective barrier is mounted in a stored position within a furniture unit positioned adjacent the bottom of the window.

Referring to FIG. 1, there is shown a window W in a building B. A credenza or other furniture unit or housing 10 is mounted at the base of the window W and preferably is of a width at least as wide as the window. The credenza 10 is provided with a top panel 12 that is normally closed but can be easily opened, and encloses a collapsed airbag 14 and a gas generating unit 16 for inflating the airbag. The airbag 14 is of a size to cover the window W when it is fully inflated.

Figure 2:
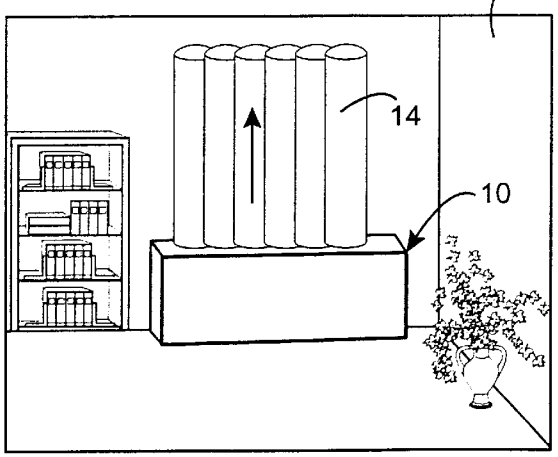
FIG. 2 is a front elevational view of the first embodiment shown in FIG. 1 wherein the protective barrier is deployed.

The gas generating unit 16 is connected to a sensor (not shown) located outside of the building B. In the event of an explosion or the like outside of the building, the sensor activates the gas generating unit 16 to inflate the airbag 14 to cover the window in the manner shown in FIG. 2. The inflated airbag 14 serves as a protective barrier to protect the occupants of the building from injury from flying debris from the window.

Figure 3:
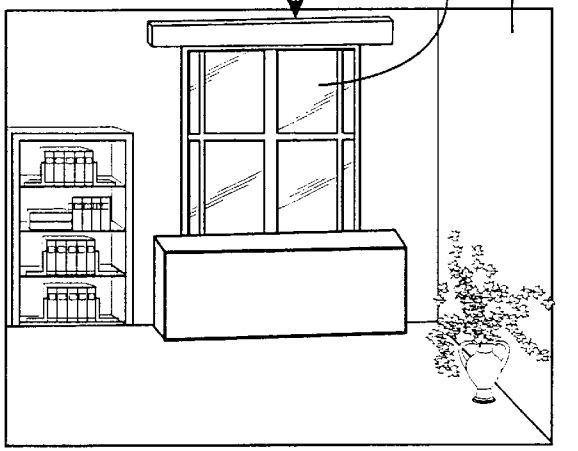
FIG. 3 is a front elevational view of a second embodiment wherein the protective barrier is mounted in a stored position within a valance unit positioned adjacent the top of the window.
Figure 4:
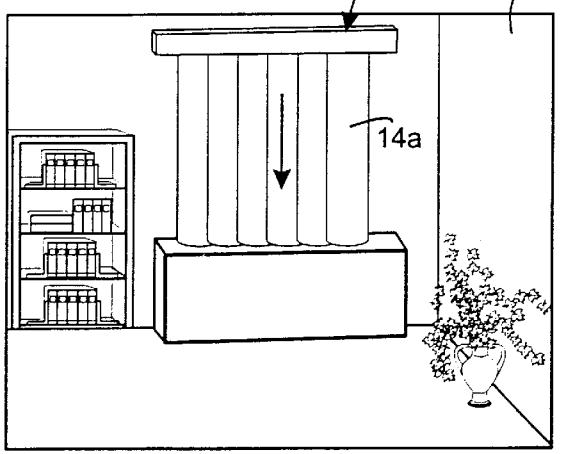
FIG. 4 is a front elevational view of the second embodiment shown in FIG. 3 wherein the protective barrier is deployed.

FIG. 3 illustrates a modified form of the present invention wherein the airbag 14*a* and gas generating unit 16*a* are located in a valance unit or housing 10*a* mounted adjacent to the top of the window W in the building B. Upon the occurrence of an explosion or the like outside of the building B, the sensor (not shown) will activate the gas generating unit 16*a* to inflate the airbag 14*a* so that it covers the window in the manner shown in FIG. 4 to protect the occupants of the building from flying debris from the window.

The gas generating unit 16, 16*a* may be of any suitable type of construction, for example, one that utilizes a solid propellant, a liquid propellant, or a mixture thereof. Preferably the gas generating unit is operable to inflate the airbag in about one millisecond.

The airbag 14, 14*a* preferably is formed of a tear-resistant fabric such as Kevlar, Nylon or the like.

Figure 5:
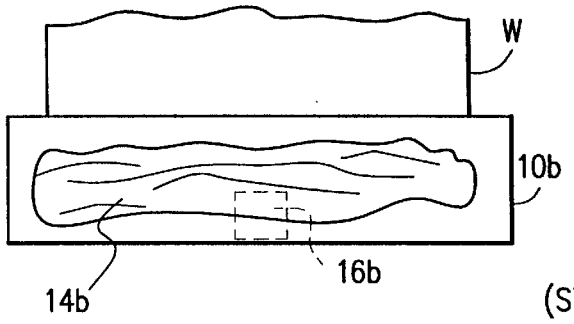
FIG. 5 is a front elevational view of a third embodiment of the present invention showing a modified form of protective barrier in a stored position.
Figure 6:
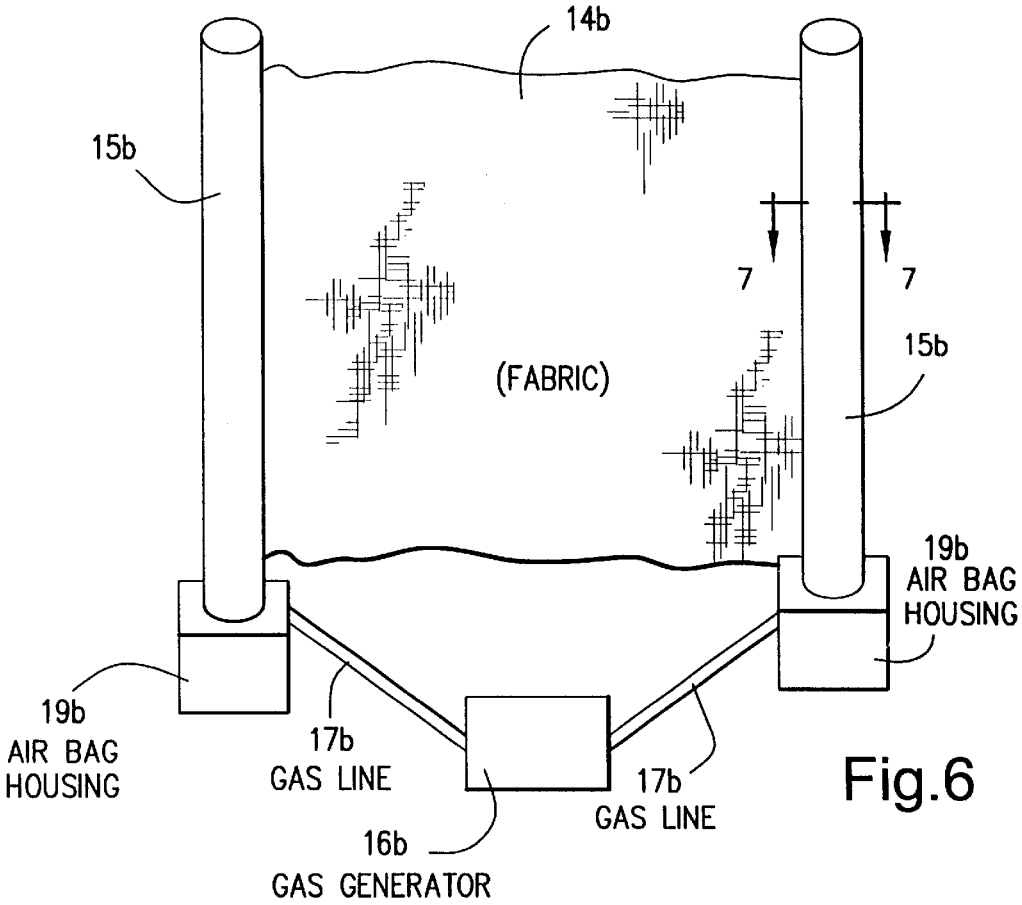
FIG. 6 is a front elevational view similar to FIG. 5 showing the modified protective barrier in a deployed position.
Figure 7:
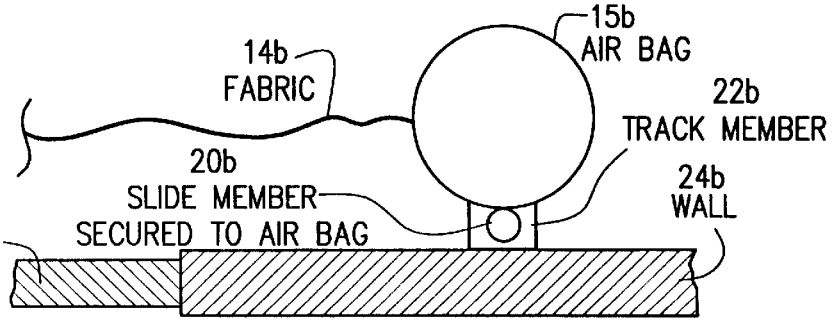
FIG. 7 is a sectional view taken substantially along line 7—7 in FIG. 6.

FIGS. 5–7 illustrate a further embodiment of the present invention wherein the protective barrier is formed of a layer of tear-resistant fabric 14*b* having inflatable side portions 15*b* to deploy the fabric to a position wherein it covers the window in the event of an explosion or the like. Referring to FIG. 5, the protective fabric 14*b* and inflatable side portions 15*b* may be stored in a collapsed position in a furniture unit or housing 10*b* disposed adjacent the window W. A gas generating unit 16*b* is also located within the housing 10*b*.

In a manner similar to the embodiments shown in FIGS. 1–4, if there is an explosion outside the building, the sensor (not shown) activates the gas generating unit 16*b* to create inflation gas that is directed through gas lines 17*b* to airbag housings 19*b* for the purpose of inflating the side portions 15*b* of the protective fabric 14*b* to deploy it to the position of FIG. 6 wherein it covers the window to protect the occupants of the building from flying debris from the window in the event of an explosion or the like.

As shown in FIG. 7, the inflatable side portions 15*b* of the protective fabric 14*b* may be provided with one or more slide members 20*b* that are slidably mounted in adjacent longitudinal track members 22*b* mounted on the wall 24*b* disposed on both sides of the window W. In operation, when the side portions 15*b* are inflated, the slide members 20*b* move upwardly (or downwardly depending on the location of the housing 10*b* relative to the window) in the track members 22*b* to deploy the protective fabric 14*b* to the position shown in FIG. 6 wherein it covers the window.

Figure 8:
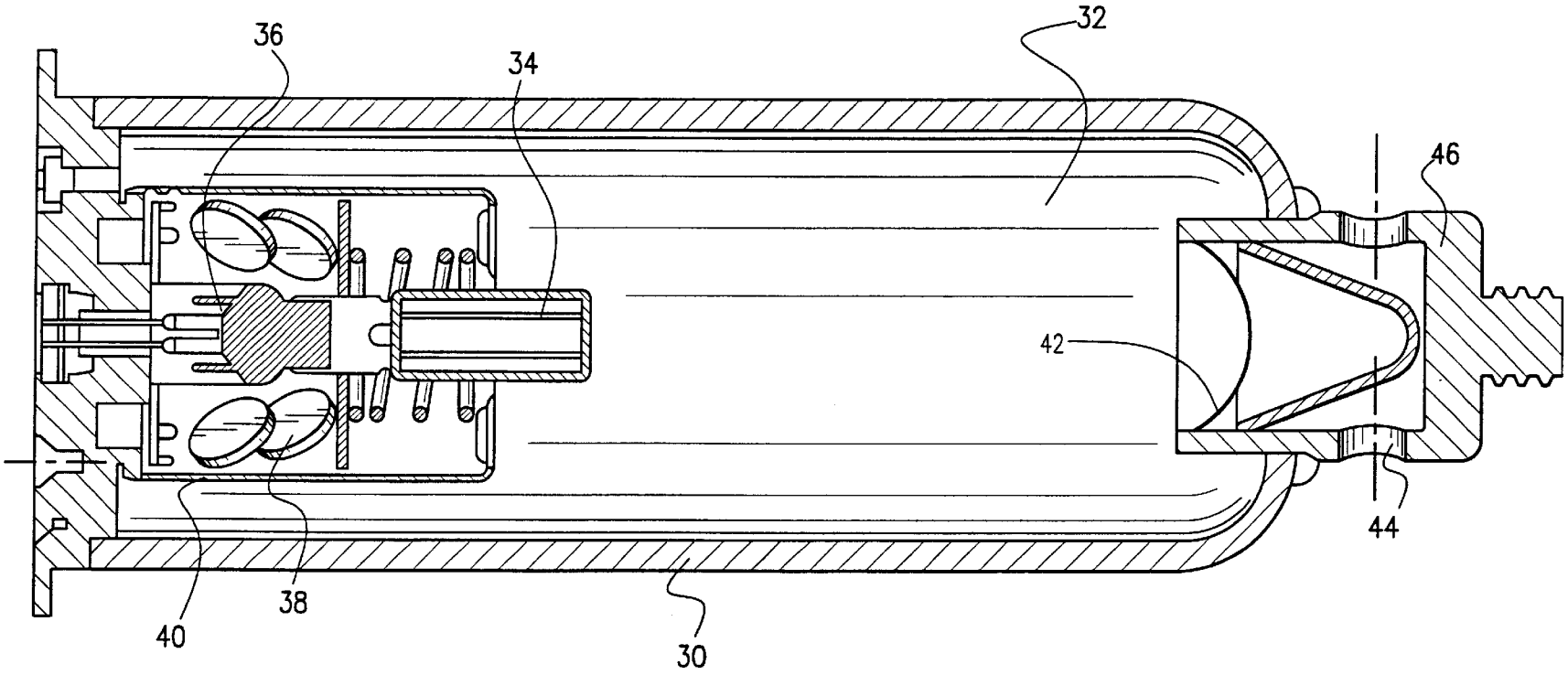
FIG. 8 is a side elevational view, partly in section, of one example of a gas generating device for effecting the deployment of the protective barrier of the present invention by inflation.
Figure 9:
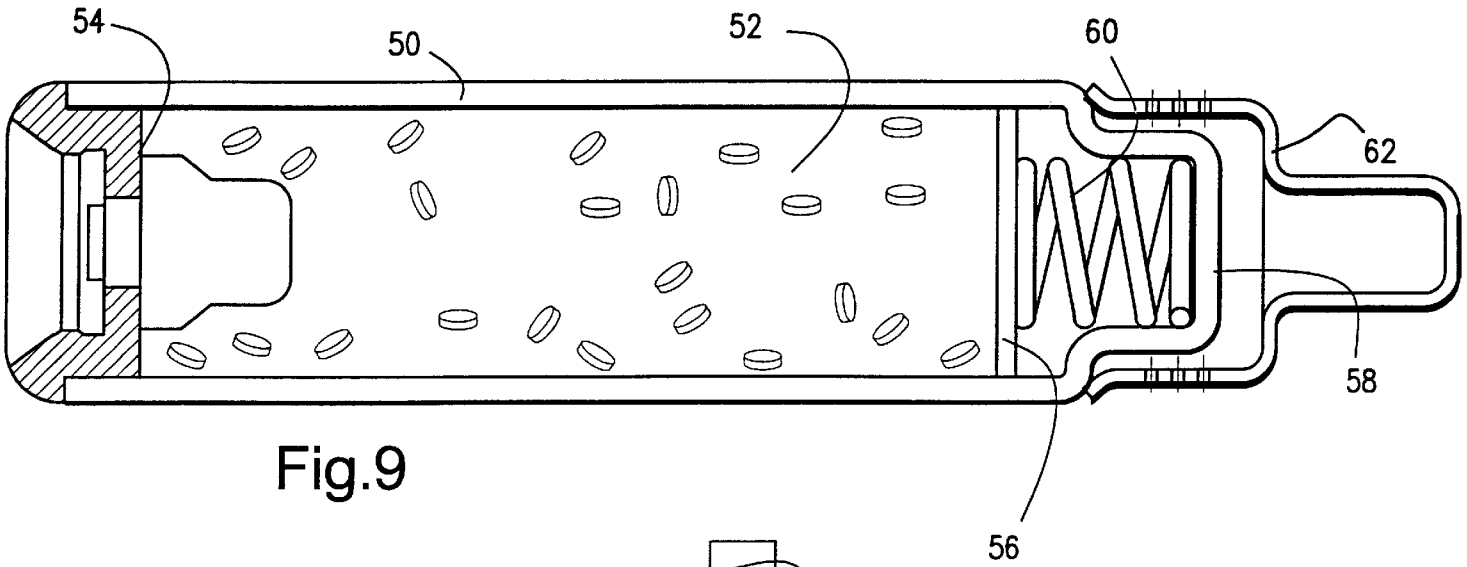
FIG. 9 is a side elevational view of another embodiment of the gas generating device shown in FIG. 8.

FIGS. 8 and 9 illustrate two embodiments of gas generating units that could be used with the occupant protection apparatus and method of the present invention. In the gas generating unit of FIG. 8, a pressure vessel 30 is used to store an inflation gas mixture 32 under pressure. An ignition charge 34, i.e., a detonatable substance that detonates as a result of a signal, such as an electrical impulse from a sensor (not shown), is also present in the pressure vessel 30. Upon the detection of an explosion or the like, the sensor activates an igniter 36 which causes the ignition charge 34 to combust. This generates sufficient heat to cause a main generant charge 38 in a generant container 40 to burn and generate gases which pass through openings into the pressure vessel. The generated gas in combination with the stored inflation gas mixture 32 creates sufficient pressure to rupture a seal disc 42 and pass through outlet ports 44 in a manifold 46 positioned at one end of the pressure vessel. Thereafter, the expelled gases are conducted to the air bag or bags to inflate them.

FIG. 9 illustrates a modified gas generating unit wherein no gas is present until the igniter causes the propellant to break down and release the non-toxic particulate-free gases. Since no part of the inflator is reserved for storage capacity, the device may be smaller than the gas generating unit of FIG. 8. A cartridge 50 holds a gas generant 52. At one end of the cartridge 50 is an initiator 54 that will combust to ignite the gas generant 52 in response to a signal from the sensor (not shown) which generates the signal as a result of an explosion or the like.

The end of the gas generating device opposite from that containing the initiator 54 holds a screen 56 upon which any particulates in the produced gas are retained, a burst disc 58, which is ruptured when the gas pressure exceeds a predetermined value, permitting the gas to escape from the cartridge 50, and a spring 60 to maintain a specific distance between the burst disc 58 and the screen 56. To ensure that the expelled gas is not released in an unduly strong stream, a diffuser 62 is affixed to the discharge end of the inflator.

It will be readily seen, therefore, that the different embodiments of the occupant protection apparatus and method of the present invention provide simple and effective protection for the occupants of a building from flying debris from windows or the like in the event of an explosion outside the building. The protective barriers of the present invention have been shown in the drawings as being mounted on the inside of the window. In some cases, the protective barrier could be mounted on the outside of the window.

Figure 10:
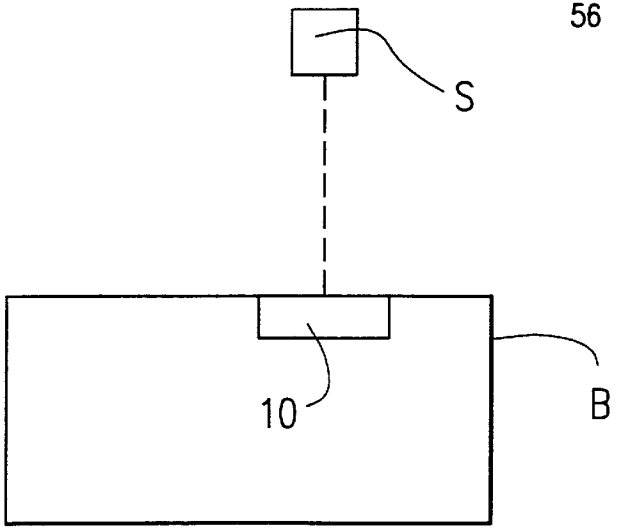
FIG. 10 is a schematic view of a sensor and a protective barrier of the present invention relative to a building in which it is used.

Preferably, as shown in FIG. 10, a sensor S is located outside of and remote from the building B and is operatively connected to the occupant protection apparatus 10 so as to deploy the protective barrier to cover the window before it is subjected to the pressure wave and debris from the explosion.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. Apparatus in combination with a building for protecting an occupant of the building from flying debris from a frangible structure thereof, such as a window, in the event of an explosion or other blast, said apparatus comprising:

a protective barrier disposed within said building adjacent said building structure, said protective barrier being constructed to be deployed by inflation of at least a portion thereof, and being movable from a stored position adjacent said building structure to a deployed position in which said protective barrier covers said building structure;

a gas generating device connected to said protective barrier and being operable to move said protective barrier to said deployed position by inflation thereof in the event of an explosion or other blast;

said building structure having a first side and a second side opposite to said first side;

said protective barrier being mounted in a housing disposed adjacent to said first side of said building structure and having a free outer end which is moved to a position adjacent said second side of said building structure when said protective barrier is inflated and moved to said deployed position, whereby said free end of said protective barrier is movable inwardly when subjected to an explosion or other blast to absorb energy therefrom and to present a barrier to flying debris from said building structure; and a sensing device located remote from the building and being connected to said gas generating device, said sensing device being operable to effect the operation of said gas generating device in the event of an explosion or other blast.

2. The apparatus of claim 1 wherein said housing is disposed in a credenza unit located below said building structure.

3. The apparatus of claim 1 wherein said protective barrier comprises an inflatable bag formed of a tear resistant material.

4. The apparatus of claim 1 wherein said protective barrier comprises a sheet of tear resistant material having an inflatable portion.

5. The apparatus of claim 4 wherein said sheet comprises inflatable portions on opposite sides thereof.

6. The apparatus of claim 5 wherein said inflatable portions are mounted for slidable movement adjacent opposite sides of said building structure, whereby upon inflation of said inflatable portions, said sheet is moved to said deployed position wherein it covers said building structure.

7. The apparatus of claim 4 wherein said sheet is formed of a reinforced fabric material.

8. The apparatus of claim 1 wherein said gas generating device comprises an ignitable gas generating composition that generates sufficient gas when ignited to deploy said protective barrier in about one millisecond.

9. The apparatus of claim 8 wherein said gas generating composition comprises a solid propellant.

10. The apparatus of claim 8 wherein said gas generating composition comprises a liquid propellant.

11. The apparatus of claim 1 wherein said housing is disposed in a valance unit located above said building structure.

12. A method of protecting an occupant of a building from flying debris from a frangible structure thereof, such as a window, in the event of an explosion or other blast, comprising the steps of:

providing an inflatable protective barrier in a housing in the building adjacent to one side of said building structure, said protective barrier being movable from a stored position in said housing to a deployed position in which it covers said building structure and the end of said protective barrier remote from said housing is free so as to be movable inwardly relative to said building structure; and inflating said protective barrier to move it to said deployed position by activating a gas generating device connected thereto in response to the sensing of an explosion or other blast, whereby the inward movement of the free end of said protective barrier absorbs energy from the explosion or blast and presents a barrier to flying debris from said building structure.

* * * * *